US008879932B2

(12) United States Patent
Okabayashi et al.

(10) Patent No.: US 8,879,932 B2
(45) Date of Patent: Nov. 4, 2014

(54) IMAGE FORMING APPARATUS AND IMAGE FORMING METHOD USING TONERS WITH DIFFERENT SOFTENING POINTS

(75) Inventors: Yasuto Okabayashi, Kanagawa (JP); Masataka Konishi, Kanagawa (JP); Shigeo Ohno, Kanagawa (JP); Yoshihiro Hayashi, Kanagawa (JP); Masafumi Okabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 353 days.

(21) Appl. No.: 13/397,449

(22) Filed: Feb. 15, 2012

(65) Prior Publication Data

US 2013/0071133 A1 Mar. 21, 2013

(30) Foreign Application Priority Data

Sep. 15, 2011 (JP) ..... 2011-201764

(51) Int. Cl.
*G03G 15/01* (2006.01)
*G03G 15/00* (2006.01)
*G03G 15/20* (2006.01)

(52) U.S. Cl.
CPC ..... *G03G 15/0189* (2013.01); *G03G 15/6585* (2013.01); *G03G 2215/2029* (2013.01); *G03G 2215/00143* (2013.01); *G03G 15/205* (2013.01)
USPC ..... 399/40

(58) Field of Classification Search
USPC ..... 399/40, 231, 342
See application file for complete search history.

(56) References Cited

U.S. PATENT DOCUMENTS

| | | | | |
|---|---|---|---|---|
| 5,751,432 | A * | 5/1998 | Gwaltney | 358/296 |
| 7,720,425 | B2 * | 5/2010 | Ng et al. | 399/342 |
| 2003/0219270 | A1 * | 11/2003 | Kondo | 399/69 |
| 2009/0263148 | A1 * | 10/2009 | Omata | 399/39 |
| 2010/0150622 | A1 * | 6/2010 | Ichikawa | 399/329 |
| 2011/0008086 | A1 | 1/2011 | Matsudaira et al. | |

FOREIGN PATENT DOCUMENTS

| | | | |
|---|---|---|---|
| JP | 4-204670 | A | 7/1992 |
| JP | 2010-145625 | A | 7/2010 |
| JP | 2010-224126 | A | 10/2010 |
| JP | 2011-017994 | A | 1/2011 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

An image forming apparatus includes image forming units forming toner images with first toners having different colors and a second toner having a different softening point from the first toners, an image transfer unit superposing the toner images one on top of another and transferring the superposed toner images onto a recording medium at least such that the toner image formed of the second toner is at the top of the superposed toner images, an image fixing unit fixing the transferred toner images, and an image controller that causes the image forming unit that uses the second toner to form the toner image over at least part of an image area and also causes the image transfer unit to perform the transfer such that the toner image formed of the second toner is at the top of the superposed toner images in the at least part of the image area.

11 Claims, 8 Drawing Sheets

IMAGE FORMING APPARATUS AND IMAGE FORMING METHOD USING TONERS WITH DIFFERENT SOFTENING POINTS

CROSS-REFERENCE TO RELATED APPLICATIONS

This application is based on and claims priority under 35 USC 119 from Japanese Patent Application No. 2011-201764 filed Sep. 15, 2011.

BACKGROUND (i) Technical Field

The present invention relates to an image forming apparatus and an image forming method.

(ii) Related Art

Electrophotographic image forming apparatuses are commonly known.

SUMMARY

According to an aspect of the invention, there is provided an image forming apparatus including a plurality of image forming units that form respective toner images by using respective toners including a plurality of first toners having different colors and a second toner having a different softening point from the first toners, an image transfer unit that has a mode in which the toner images formed by the image forming units are superposed one on top of another and are transferred onto a recording medium at least such that one of the toner images that is formed of the second toner is at the top of the superposed toner images, an image fixing unit that fixes the toner images transferred onto the recording medium by the image transfer unit on the recording medium, and an image controller that causes, when the image transfer unit is in the mode, one of the image forming units that uses the second toner to form the toner image over at least part of an image area and also causes the image transfer unit to transfer the toner images onto the recording medium such that the toner image formed of the second toner is at the top of the superposed toner images in the at least part of the image area.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described.

Figure 1:
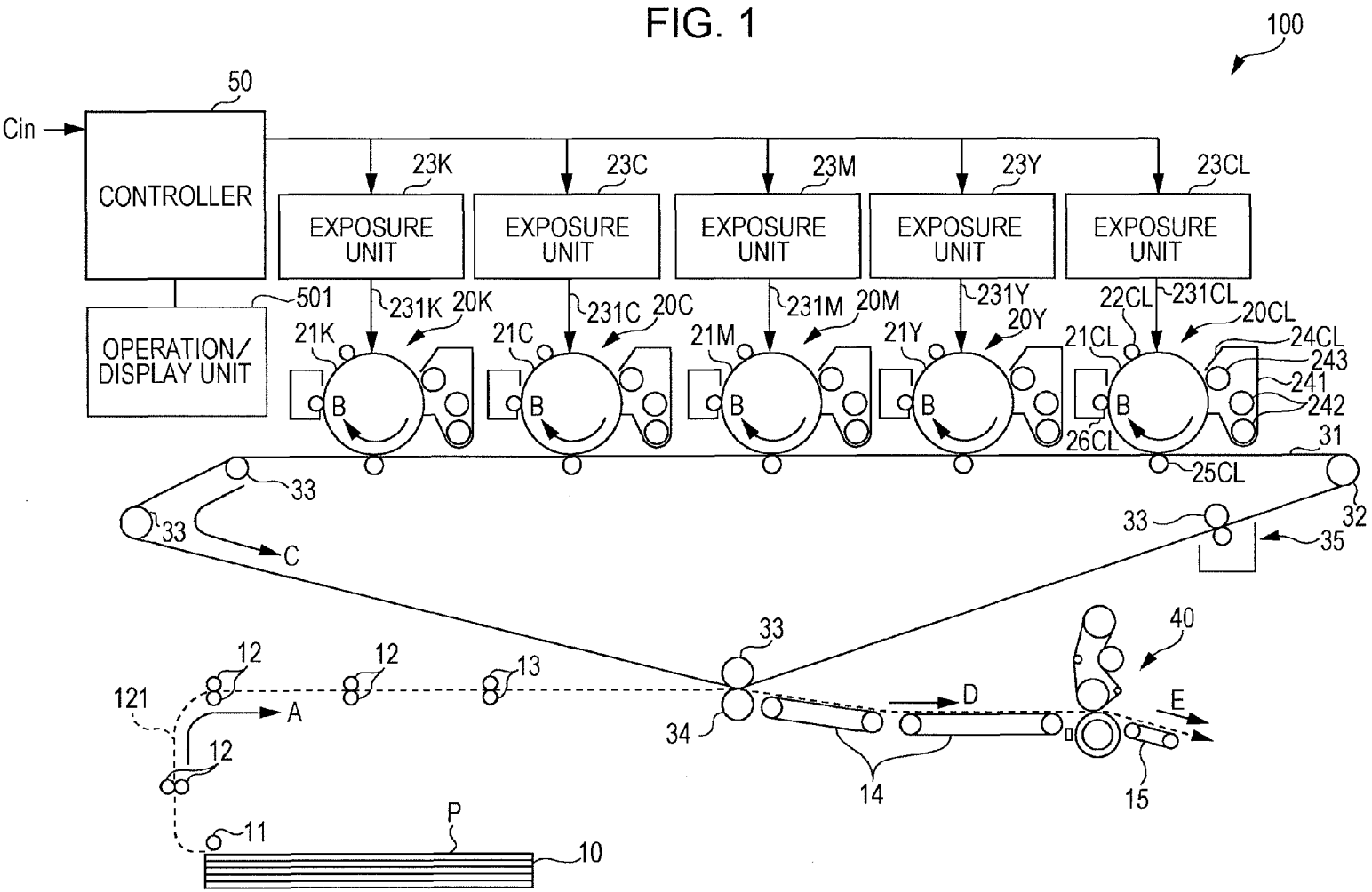
FIG. 1 is a schematic diagram of an image forming apparatus according to an exemplary embodiment of the present invention.

FIG. 1 is a schematic diagram of an image forming apparatus 100 according to an exemplary embodiment of the present invention.

The image forming apparatus 100 includes a paper tray 10 at the bottom thereof. Pieces of papers P are stacked on the paper tray 10. An image is formed as follows. A piece of paper P is fed from the paper tray 10 by a pickup roller 11 and is transported by transport rollers 12 along a transport path 121 in a direction indicated by arrow A up to standby rollers 13, where the timing of the subsequent transport operation is adjusted. The transport operation from the standby rollers 13 will be described separately below.

The image forming apparatus 100 also includes five image forming engines 20CL, 20Y, 20M, 20C, and 20K. The image forming engines 20CL, 20Y, 20M, 20C, and 20K form toner images by using a transparent/clear (CL) toner, a yellow (Y)-colored toner, a magenta (M)-colored toner, a cyan (C)-colored toner, and a black (K)-colored toner, respectively. The softening points of the Y-, M-, C-, and K-colored toners employed in the image forming apparatus 100 according to the present exemplary embodiment are higher than those of toners employed in related-art image forming apparatuses of the same type as the image forming apparatus 100. The softening point of the CL toner of the image forming apparatus 100 is lower than those of the Y-, M-, C-, and K-colored toners. This feature will be described in detail separately below. The five image forming engines 20CL, 20Y, 20M, 20C, and 20K all have the same configuration except the toners. Hence, among the five image forming engines 20CL, 20Y, 20M, 20C, and 20K, the image forming engine 20CL will be described hereafter.

The image forming engine 20CL includes a photoconductor 21CL, and also includes a charger 22CL, an exposure unit 23CL, a development unit 24CL, a first transfer member 25CL, and a cleaner 26CL that are provided around the photoconductor 21CL. The first transfer member 25CL is provided across a below-described intermediate transfer belt 31 from the photoconductor 21CL.

The photoconductor 21CL has a round cylindrical shape. The photoconductor 21CL is electrically charged while rotating in a direction indicated by arrow B. The electric charge generated on the surface of the photoconductor 21CL is released when the photoconductor 21CL is exposed to light. Thus, the photoconductor 21CL carries an electrostatic latent image.

The charger 22CL charges the surface of the photoconductor 21CL to a certain potential.

The exposure unit 23CL receives image data (in the case of the image forming engine 20CL according to the present exemplary embodiment that uses the CL toner, image data representing a uniform image, which will be described in detail separately below) that is input thereto from a below-described controller 50. The exposure unit 23CL emits an exposure light beam 231CL modulated in accordance with the image data received. The photoconductor 21CL having been charged by the charger 22CL is exposed to the exposure light beam 231CL emitted from the exposure unit 23CL, whereby an electrostatic latent image is formed on the surface of the photoconductor 21CL.

The electrostatic latent image formed on the surface of the photoconductor 21CL through the exposure with the exposure light beam 231CL is developed by the development unit 24CL, whereby a toner image (in the case of the image forming engine 20CL, a uniform toner image formed of the clear (CL) toner) is formed on the photoconductor 21CL.

The development unit 24CL includes a casing 241 containing developer composed of a toner and a carrier, and also includes, in the casing 241, two augers 242 that agitate the developer and a development roller 243 that transports the developer to a position facing the photoconductor 21CL. When the electrostatic latent image formed on the photoconductor 21CL is developed, a bias voltage is placed across the development roller 243. By the effect of the bias voltage, the toner in the developer adheres to the electrostatic latent image formed on the photoconductor 21CL. Thus, a toner image is formed.

The toner image on the photoconductor 21CL obtained through the development performed by the development unit 24CL is first-transferred onto the intermediate transfer belt 31 by the first transfer member 25CL.

Some toner remaining on the photoconductor 21CL after the first transfer is removed from the photoconductor 21CL by the cleaner 26CL.

The intermediate transfer belt 31 is an endless belt that is stretched around a driving roller 32 and other plural rollers 33. The intermediate transfer belt 31 rotates in a direction indicated by arrow C.

Toner images formed by the respective image forming engines 20CL, 20Y, 20M, 20C, and 20K using the CL, Y, M, C, and K toners are first-transferred onto the intermediate transfer belt 31 in such a manner as to be sequentially superposed one on top of another, with the toner image formed by the image forming engine 20CL using the CL toner lying at the bottom. The superposed toner images are transported to a second transfer position, where a second transfer member 34 is provided. Simultaneously, the piece of paper P having been transported to the standby rollers 13 is transported to the second transfer position. Then, the superposed toner images on the intermediate transfer belt 31 are second-transferred onto the piece of paper P by the second transfer member 34. As a result of second-transferring the superposed toner images from the intermediate transfer belt 31 to the piece of paper P, the order of toner images is reversed. That is, the toner image formed of the CL toner is at the top of the superposed toner images on the piece of paper P. The piece of paper P having the superposed toner images second-transferred thereonto is further transported by a transport belt 14 in a direction indicated by arrow D to a fixing unit 40, where the superposed toner images are fixed on the piece of paper P with pressure and heat applied by the fixing unit 40. Thus, an image formed of the superposed toner images thus fixed is provided on the piece of paper P. The piece of paper P having the fixed image is transported by a transport belt 15 in a direction indicated by arrow E and is then discharged to the outside of the image forming apparatus 100.

After the superposed toner images are second-transferred to the piece of paper P by the second transfer member 34, the intermediate transfer belt 31 further rotates, whereby some toner remaining on the surface of the intermediate transfer belt 31 is removed by a cleaner 35.

The image forming apparatus 100 includes the controller 50 and an operation/display unit 501. Image data Cin is input to the controller 50. The controller 50 processes the image data Cin in accordance with control data that is input thereto together with the image data Cin or in accordance with an instruction made through the operation/display unit 501, so that the image data Cin is converted into pieces of image data with which desired exposure light beams 231CL, 231Y, 231M, 231C, and 231K can be emitted from the respective exposure units 23CL, 23Y, 23M, 23C, and 23K. The pieces of image data obtained through the above conversion are transmitted to the respective exposure units 23CL, 23Y, 23M, 23C, and 23K. The exposure units 23CL, 23Y, 23M, 23C, and 23K apply the exposure light beams 231CL, 231Y, 231M, 231C, and 231K to the photoconductors 21CL, 21Y, 21M, 21C, and 21K, respectively, in accordance with the pieces of image data on the CL, Y, M, C, and K colors that are input thereto. The processing operation performed by the controller 50 will be described in detail separately below.

The operation/display unit 501 functions as a man-machine interface that displays various messages about the image forming apparatus 100 to the user. The operation/display unit 501 also displays various operation buttons and accepts instructions concerning image formation that are made through the buttons by the user.

Figure 2:
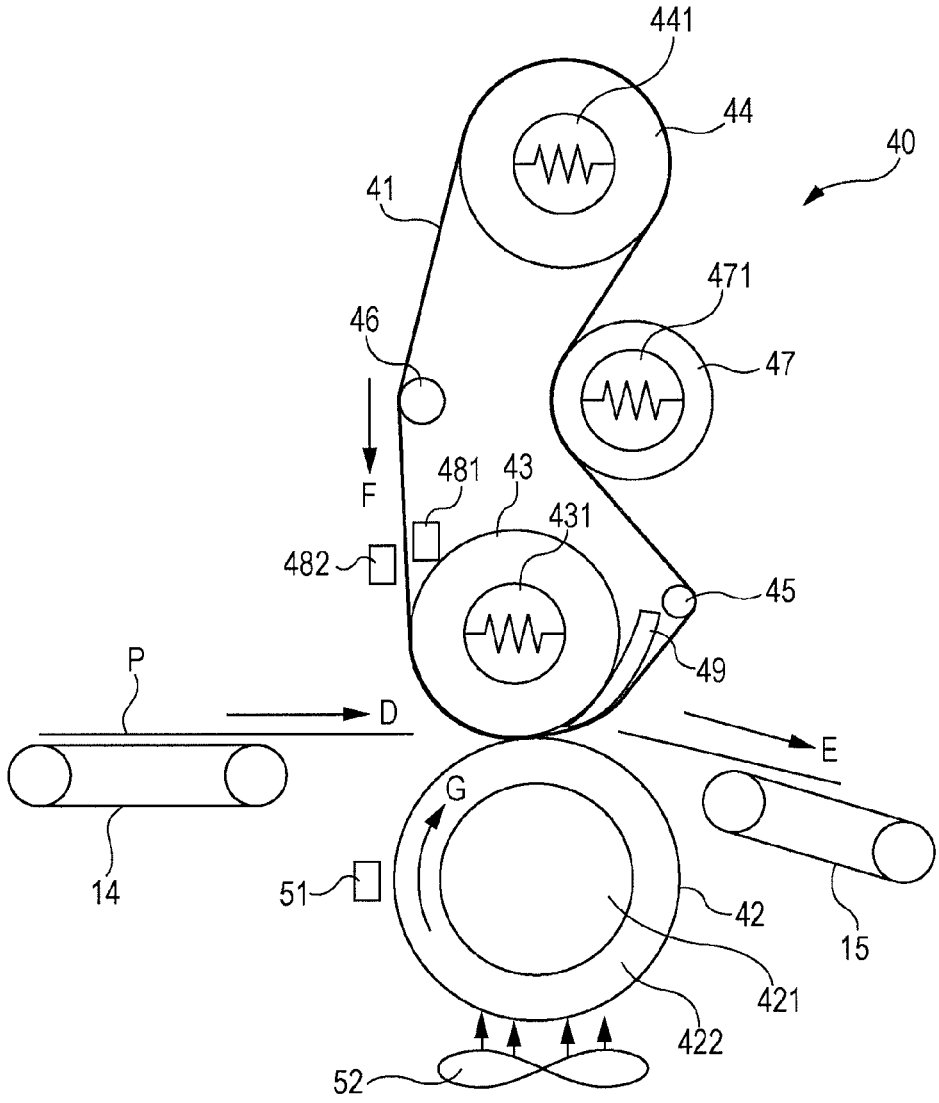
FIG. 2 is a schematic diagram of a fixing unit included in the image forming apparatus illustrated in FIG. 1.

FIG. 2 is a schematic diagram of the fixing unit 40 included in the image forming apparatus 100 illustrated in FIG. 1.

The fixing unit 40 includes an endless heat belt 41 that rotates in a direction indicated by arrow F, a pressure roller 42 that rotates in a direction indicated by arrow G, a heat roller 43 provided on the inner side of the heat belt 41 and across the heat belt 41 from the pressure roller 42, and a stretch roller 44 provided farthest from the pressure roller 42. The fixing unit 40 also includes a stretch roller 45, a position control roller 46 that prevents the heat belt 41 from meandering, and a stretch roller 47. The stretch rollers 45 and 47 and the position control roller 46 are provided between the heat roller 43 and the stretch roller 44. The stretch roller 47 is pressed against the heat belt 41 from the outer side of the heat belt 41.

The heat roller 43 and the two stretch rollers 44 and 47 are provided thereinside with respective heaters 431, 441, and 471. The heat belt 41 is heated by the heat roller 43 and the stretch rollers 44 and 47. Temperature sensors 481 and 482 are provided on the inner and outer sides, respectively, of the heat belt 41 and measure the temperature of the heat belt 41. The heaters 431, 441, and 471 are controlled so that the heat belt 41 is heated to a desired temperature.

A release pad 49 is provided adjacent to the heat roller 43. The release pad 49 is positioned on the inner side of the heat belt 41 and on the downstream side, in a paper transport direction, with respect to the heat roller 43.

The pressure roller 42 includes a core 421 and an elastic layer 422 made of rubber and provided around the core 421. A temperature sensor 51 that measures the temperature of the pressure roller 42 is provided near the pressure roller 42. A fan 52 that cools the pressure roller 42 is provided below the pressure roller 42. The rotation of the fan 52 is controlled such that the temperature of the pressure roller 42 measured by the temperature sensor 51 is maintained at a certain level.

The piece of paper P having the superposed toner images second-transferred thereonto from the intermediate transfer belt 31 by the second transfer member 34 illustrated in FIG. 1 is transported by the transport belt 14 in the direction of arrow D into the nip between the heat belt 41 and the pressure roller 42, advances through the nip while being pressed against the heat belt 41 by the pressure roller 42, is released from the heat belt 41 with the aid of the release pad 49, and is further transported by the transport belt 15 in the direction of arrow E. The superposed toner images on the piece of paper P are melted while being transported through the fixing unit 40 and are then hardened, whereby an image formed of the superposed toner images thus fixed is provided on the piece of paper P. The piece of paper P having passed through the fixing unit 40 is discharged to the outside of the image forming apparatus 100 illustrated in FIG. 1, as described above.

The image forming apparatus 100 illustrated in FIG. 1 employs the Y-, M-, C-, and K-colored toners having softening points higher than those of related-art toners and also employs the clear (CL) toner having a softening point as low as those of related-art toners, as described above. The reason for this will now be described.

Figure 3A:
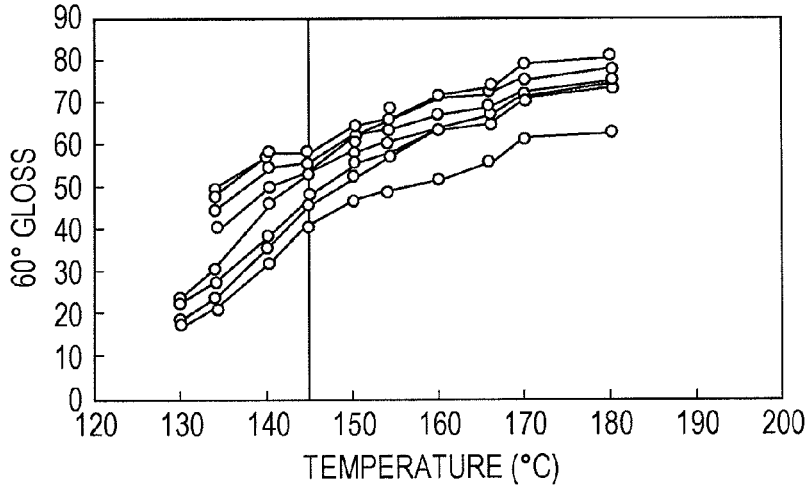
FIGS. 3A to 3C are graphs illustrating the gloss level of an image formed on paper versus the temperature of a heat belt of the fixing unit in respective cases of different softening points of toners.
Figure 3B:
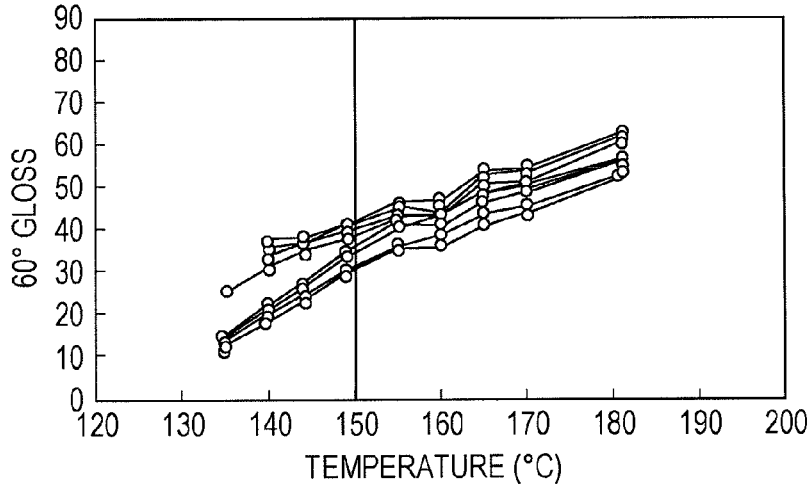
Figure 3C:
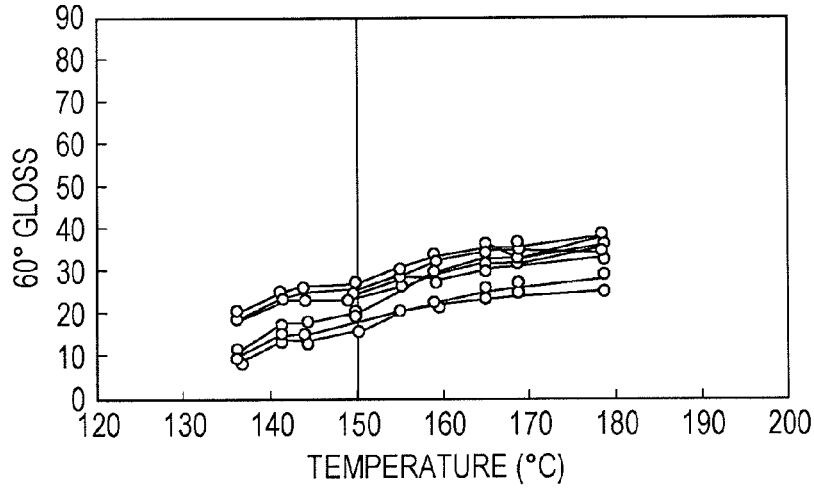
Figure 4:
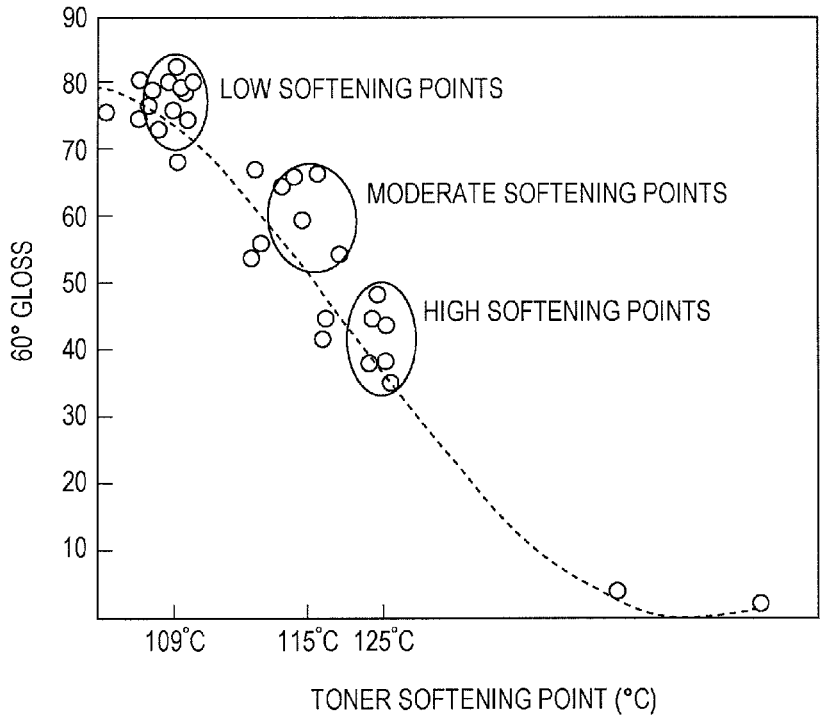
FIG. 4 is a graph illustrating the gloss level versus the softening point of toner.

FIGS. 3A to 3C are graphs illustrating the gloss level of the image formed on paper versus the temperature of the heat belt 41 of the fixing unit 40 in respective cases of different softening points of toners. FIG. 4 is a graph illustrating the gloss level versus the softening point of toner.

The present exemplary embodiment concerns measurements conducted with Flowtester CFT-500D (manufactured by Shimadzu Corporation), with a die having a 0.5 mm inside diameter, with a pressure load of 0.98 MPa, and at a rate of temperature rise of 1° C./min. In the measurements, the softening point of toner is defined as the temperature corresponding to half the descent speed (the temperature corresponding to half the distance from a point where sample toner that is caused to melt starts to flow to a point where the melted sample toner stops flowing). The gloss level is measured at 60° with respect to the image formed on a piece of paper called "Mirrorkote Platinum" weighing 256 gsm. Referring to FIG. 4, toners whose softening points are about 109° C. are designated as low-softening-point toners, toners whose softening points are about 115° C. are designated as moderate-softening-point toners, and toners whose softening points are about 125° C. are designated as high-softening-point toners.

FIG. 3A illustrates the 60° gloss level (vertical axis) versus the temperature of the heat belt 41 of the fixing unit 40 (horizontal axis) in several cases where images of various colors such as primary colors (Y, M, C, and K) and secondary colors (red (R), green (G), and blue (B)) are formed on the paper by using low-softening-point toners. Similarly to FIG. 3A, FIG. 3B illustrates other cases where moderate-softening-point toners are used, and FIG. 3C illustrates yet other cases where high-softening-point toners are used. The vertical lines illustrated in FIGS. 3A to 3C each represent the lowest point of a temperature range (of the heat belt 41) in which satisfactory fixing quality is guaranteed. Low-softening-point toners melt at relatively low temperatures, and the lowest point of the temperature range that guarantees satisfactory fixing quality in the cases of low-softening-point toners is 145° C. as illustrated in FIG. 3A. In the cases of moderate-softening-point toners (FIG. 3B) and high-softening-point toners (FIG. 3C), the lowest point of the temperature range that guarantees satisfactory fixing quality is 150° C.

Comparing the graphs illustrated in FIGS. 3A to 3C, the gloss level of the image is higher in the cases where low-softening-point toners are used and is lower in the cases where high-softening-point toners are used.

The dotted curve of the graph illustrated in FIG. 4 represents the average 60° gloss level versus the softening point among several cases where images are formed by using various toners whose softening points are different and at the respective lowest points of the temperature range that guarantee satisfactory fixing quality corresponding to the respective softening points.

The graph in FIG. 4 shows that the gloss level becomes lower as the softening point of toner becomes higher within a range in which the toner is practically usable.

Figure 5A:
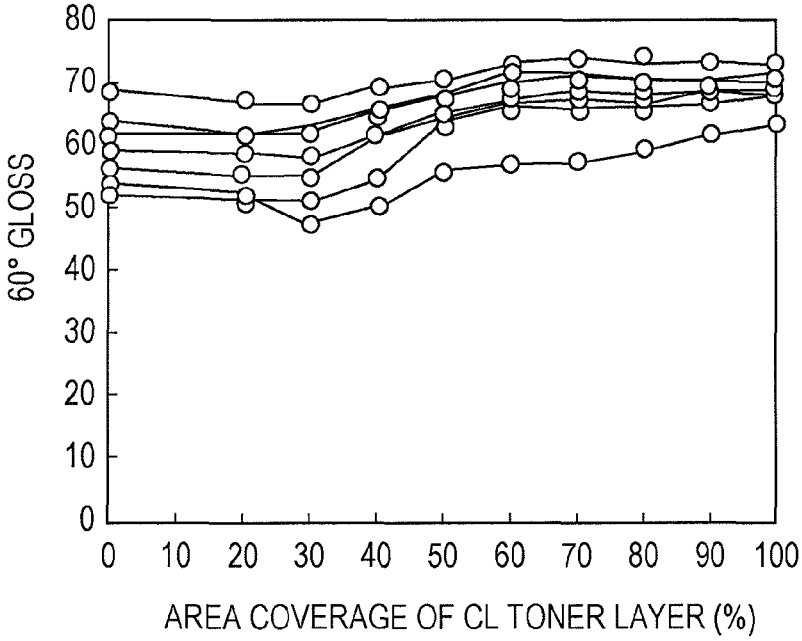
FIGS. 5A and 5B are graphs illustrating the 60° gloss level versus the area coverage (%) of a clear (CL) toner in various cases where various colored images are each covered with a uniform image formed of the CL toner.
Figure 5B:
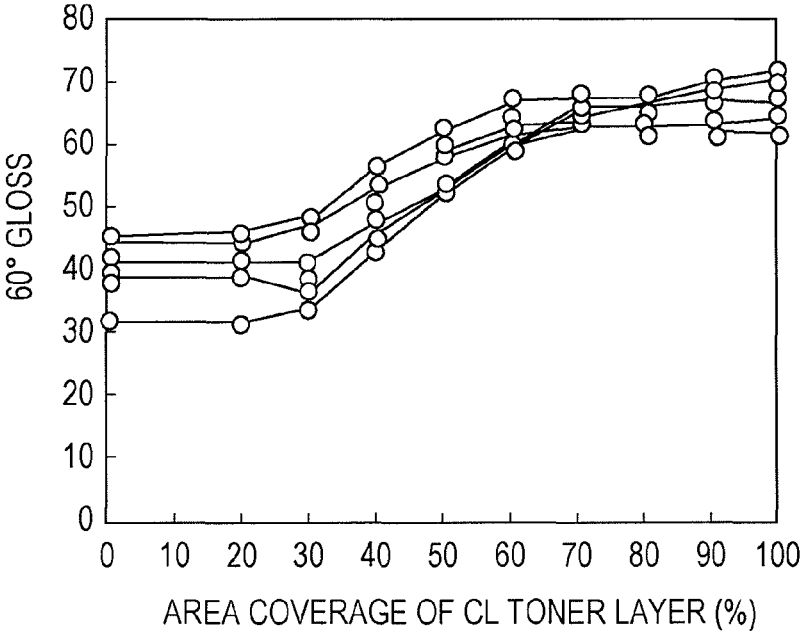

FIGS. 5A and 5B are graphs illustrating the 60° gloss level versus the area coverage (%) of the CL toner in various cases where uniform images having primary colors (Y, M, C, and K), secondary colors (R, G, and B), and the like formed of colored toners are each covered with a uniform image formed of the CL toner.

FIG. 5A illustrates cases in each of which both the colored toner and the CL toner have low softening points. FIG. 5B illustrates cases in each of which the colored toner has a high softening point whereas the CL toner has a low softening point.

Referring to FIG. 5A, in each case where both the colored toner and the CL toner have low softening points, the gloss level does not change greatly regardless of the area coverage (%) of the CL toner provided at the top of the image, that is, whether or not the CL toner is present at the top of the image.

In contrast, referring to FIG. 5B, in each case where the colored toner (Y, M, C, or K) has a high softening point and the CL toner has a low softening point, the gloss level is low when the CL toner is not present at the top of the image or when the CL toner is provided at the top of the image with a low area coverage (about 0% to 20%), whereas the gloss level is as high as those in the cases illustrated in FIG. 5A when the CL toner is provided at the top of the image with a high area coverage (about 70% to 100%). It is also shown that, within a range in which the area coverage of the CL toner provided at the top of the image is moderate (about 30% to 60%), the gloss level becomes higher with the increase in the area coverage of the CL toner.

In view of the above, the gloss level of the image is changeable by employing a high-softening-point colored toner (Y, M, C, or K) and a low-softening-point CL toner and selecting whether or not to provide the low-softening-point CL toner at the top of the image to be formed on the paper. Moreover, the gloss level of the image is changeable among plural levels by changing, within the moderate range, the area coverage of the low-softening-point CL toner to be provided at the top of the image.

Figure 6:
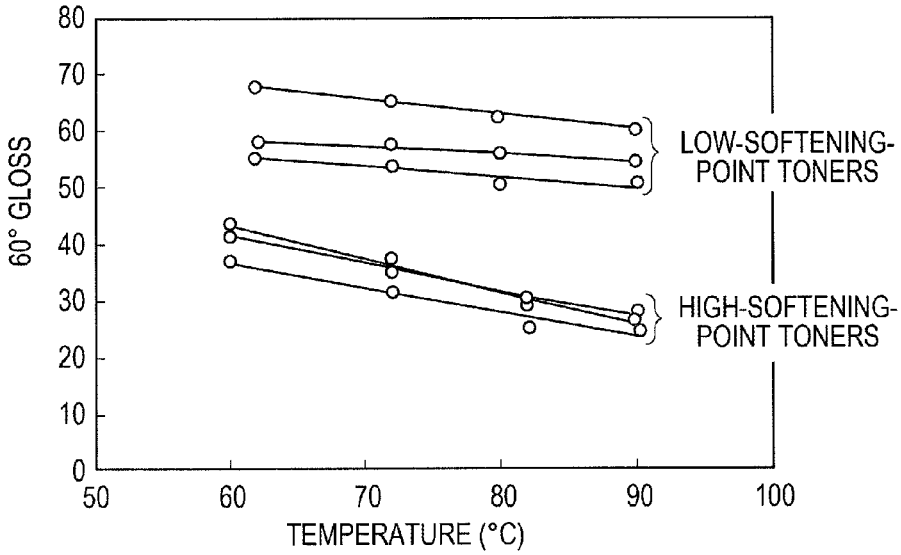
FIG. 6 is a graph illustrating the 60° gloss level versus the temperature of a pressure roller of the fixing unit illustrated in FIG. 2.

FIG. 6 is a graph illustrating the 60° gloss level versus the temperature of the pressure roller 42 of the fixing unit 40 illustrated in FIG. 2 in several cases where uniform images having secondary colors (R, G, and B) are formed by using colored toners and the 60° gloss levels of the respective uniform images are measured. In each of the cases, the temperature of the heat belt 41 is set to the lowest point of the temperature range that guarantees satisfactory fixing quality in accordance with the softening point of the toner used.

As can be seen from FIG. 6, in the cases of low-softening-point toners, changes in the gloss level are very small relative to changes in the temperature of the pressure roller 42. In contrast, in the cases of high-softening-point toners, changes in the temperature of the pressure roller 42 tend to affect the gloss level of the image.

In related-art image forming apparatuses in which only low-softening-point toners are employed, the pressure roller only needs to be controlled to be at 70° C. or below so that, in a case where a toner image is to be formed on the back side of the paper already having a fixed toner image on the front side thereof, the fixed toner image on the front side of the paper is prevented from melting again at the contact with the pressure roller and causing an image defect. In contrast, in the image forming apparatus 100 (see FIG. 1) according to the present exemplary embodiment in which high-softening-point toners are employed, the pressure roller 42 is controlled to be at a specific temperature (in the present exemplary embodiment, 70° C.) while being cooled by the fan 52. This is because an image defect may occur if the temperature of the pressure roller 42 exceeds 70° C., as described above, while a problem with gloss may occur if the temperature of the pressure roller 42 is below 70° C.

In view of the above, an operation performed by the controller 50 of the image forming apparatus 100 according to the present exemplary embodiment illustrated in FIG. 1 will now be described.

Figure 7:
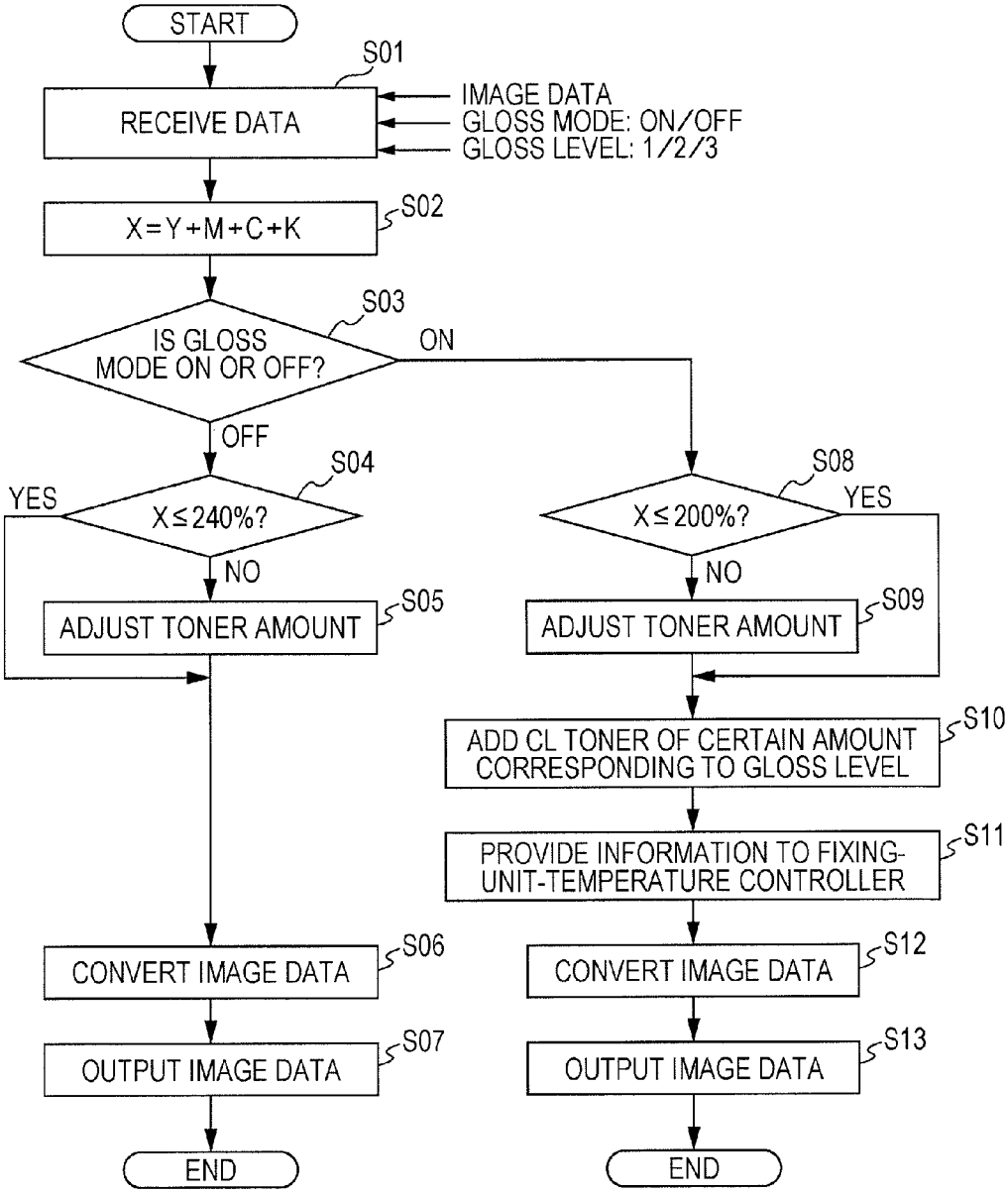
FIG. 7 is a flowchart illustrating an operation performed by a controller.

FIG. 7 is a flowchart illustrating the operation performed by the controller 50.

First, in step S01, the controller 50 receives image data Cin and acquires information on whether the gloss mode is on or off and information on the gloss level (1, 2, or 3). The information on whether the gloss mode is on or off and the information on the gloss level may be input, together with the image data Cin, from an external device or through a user's operation performed on the operation/display unit 501.

After the image data Cin is input to the controller 50, the operation proceeds to step S02, where a total thickness X of the Y, M, C, and K toners that are to form a toner image based on the image data Cin is calculated. If the total thickness X varies with the position of the expected image, the largest thickness is employed as the total thickness X. The total thickness X is referred to when it is determined whether or not satisfactory fixing will be realized. Even a small part of the image that is not fixed satisfactorily may lead to an image defect. After the total thickness X is calculated, the operation proceeds to step S03, where it is determined whether the gloss mode is on or off.

Although the information on whether the gloss mode is on or off and the information on the gloss level are herein treated as separate pieces of information for ease of understanding, the information on whether the gloss mode is on or off may be integrated into the information on the gloss level. That is, the lowest gloss level may be a level realized when an image is formed with an area coverage of the CL toner of 0% (the level realized when the gloss mode is off).

A case where the gloss mode is off (the gloss level is the lowest) will be described first.

In this case, the operation proceeds to step S04, where it is determined whether or not the total thickness X is 240% or below in dot percentage. In most images, the total thickness X is 240% or below, usually. If the total thickness X of the image exceptionally exceeds 240%, the operation proceeds to step S05, where the amount of toners is adjusted so that the total thickness X becomes 240% or below. The amount of toners is adjusted by related-art methods, for example, by replacing certain amounts of Y, M, and C toners with an amount of K toner that is equivalent thereto or by reducing the amounts of all the Y, M, C, and K toners.

If it has been determined that the total thickness X is 240% or below in step S04 or if it has been determined that the total thickness X is over 240% in step S04 and the amount of toners is therefore adjusted in step S05 so that the total thickness X becomes 240% or below, the operation proceeds to step S06, where the image data Cin is converted into data in a format that is handleable by the exposure units 23Y, 23M, 23C, and 23K illustrated in FIG. 1. Then, in step S07, the converted image data is output to the exposure units 23Y, 23M, 23C, and 23K. In this case, since the gloss mode is off (the gloss level is the lowest), the image data is not transmitted to the exposure unit 23CL for the image forming engine 20CL that uses the CL toner.

On the other hand, in step S03, if it has been determined that the gloss mode is on, the operation proceeds to step S08, where it is determined whether or not the total thickness X is 200% or below.

While a threshold of 240% is employed in step S04, another threshold 200% is employed in step S08. This is because the total thickness X of the colored toners needs to be suppressed to a relatively small value, taking into consideration that a thickness of the CL toner is to be added thereto.

In step S08, if it has been determined that the total thickness X exceeds 200%, the operation proceeds to step S09, where the amount of toners is adjusted. The adjustment of the amount of toners performed in step S09 is the same as that performed in step S05, except that the upper limit of the total thickness X is 200%.

If it has been determined that the total thickness X is 200% or below in step S08 or if it has been determined that the total thickness X is over 200% in step S08 and the amount of toners is therefore adjusted in step S09 so that the total thickness X becomes 200% or below, the operation proceeds to step S10, where a certain thickness of the CL toner corresponding to the gloss level 1, 2, or 3 is added to the total thickness X. In the present embodiment, for example, the gloss level becomes higher in the order of level 1, level 2, and level 3. Specifically, gloss level 1 corresponds to an area coverage of the CL toner of 40%, gloss level 2 corresponds to an area coverage of the CL toner of 50%, and gloss level 3 corresponds to an area coverage of the CL toner of 100%. Hence, the maximum total thickness of toners including the thickness of the CL toner defined by the area coverage comes to 300%.

The information on the total thickness of toners including the thickness of the CL toner defined by the area coverage that is calculated as described above is provided to a fixing-unit-temperature controller in step S11. In the present exemplary embodiment, the controller 50 is also responsible for the operation of controlling the temperature of the fixing unit 40. That is, the fixing-unit-temperature controller according to the present exemplary embodiment is a fixing-unit-temperature-controlling processor (not illustrated) included in the controller 50. Hence, in the present exemplary embodiment, the information on the total thickness of toners including the thickness of the CL toner defined by the area coverage is provided to the fixing-unit-temperature-controlling processor included in the controller 50.

Figure 8:
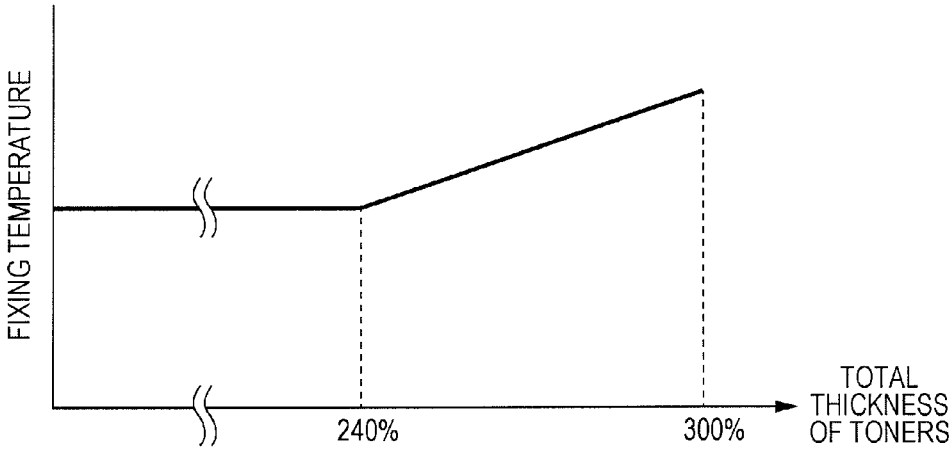
FIG. 8 is a graph illustrating the set temperature of the fixing unit (heat belt) versus the total thickness of toners.

FIG. 8 is a graph illustrating the set temperature of the fixing unit 40 (the heat belt 41) versus the total thickness of toners.

In the case where colored toners having high softening points are employed, the toners are relatively difficult to melt quickly. Moreover, if the CL toner is provided over such toners, fixing may not be performed satisfactorily. Therefore, in the present exemplary embodiment, if the total thickness of toners exceeds 240%, the set temperature of the fixing unit 40 is increased with the increase in the total thickness of toners, the maximum total thickness of toners being 300%. If the temperature of the fixing unit 40 is set so as to be constant at a level corresponding to the maximum total thickness of toners of 300%, energy is consumed excessively and it becomes difficult to protect peripheral components from being adversely affected by the heat radiated from the fixing unit 40. The total thickness of toners seldom exceeds 240% even including the thickness of the CL toner. Therefore, in the present exemplary embodiment, the fixing temperature is not constantly set to a high value but is increased with the total thickness of toners only when the total thickness of toners exceeds 240%.

The description of the operation performed by the controller 50 will be continued referring to the flowchart illustrated in FIG. 7.

After the information on the total thickness of toners is provided to the fixing-unit-temperature controller in step S11, the operation proceeds to step S12, where the image data Cin is converted into data in a format that is handleable by the exposure units 23CL, 23Y, 23M, 23C, and 23K, as with step S06. Then, in step S13, the converted image data is output to the exposure units 23CL, 23Y, 23M, 23C, and 23K. In this case, the image data is transmitted to the exposure unit 23CL for the image forming engine 20CL that uses the CL toner as well.

In the above exemplary embodiment, the image forming apparatus 100 employs high-softening-point toners as the Y-, M-, C-, and K-colored toners and a low-softening-point toner as the CL toner that is to be provided at the top of the image, whereby the gloss level is increased. Alternatively, the image forming apparatus 100 may employ low-softening-point toners as the Y-, M-, C-, and K-colored toners and a high-softening-point toner as the CL toner that is to be provided at the top of the image, whereby the gloss level may be reduced.

The above exemplary embodiment has been described on the premise that the CL toner for changing the gloss level is provided at the top of the image and over the entirety of the image area. Alternatively, the CL toner at the top of the image may be provided only in part of the image area. In that case, the gloss level in that part of the image area changes.

The above exemplary embodiment concerns an image forming apparatus employing a tandem development device, as illustrated in FIG. 1. The present invention is also applicable to, for example, an image forming apparatus employing a rotary development device that includes plural development units whose positions are changeable by the rotation of the development device. In the image forming apparatus employing a tandem development device as illustrated in FIG. 1, to provide the CL toner at the top of the image to be formed on the paper, the position of the image forming engine that uses the CL toner is automatically determined. In contrast, in the case where a rotary development device is employed, the position of the development unit that uses the CL toner is set more flexibly. Moreover, in the case where a rotary development device is employed, the gloss level of the image may be changed without using the CL toner, depending on the kind of the image to be formed. Specifically, one of the colored toners (for example, the Y toner) may have a different softening point from the other colored toners, and the gloss level of the image may be changed by selecting whether to provide the colored toner having a different softening point as the topmost layer or as any of the second-topmost and subsequent layers of the image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming units that form respective toner images by using respective toners including a plurality of first toners having different colors and a second toner having a different softening point from the first toners;

an image transfer unit that has a mode in which the toner images formed by the image forming units are superposed one on top of another and are transferred onto a recording medium at least such that one of the toner images that is formed of the second toner is at the top of the superposed toner images;

an image fixing unit that fixes the toner images transferred onto the recording medium by the image transfer unit on the recording medium; and an image controller that causes, when the image transfer unit is in the mode, one of the image forming units that uses the second toner to form the toner image over at least part of an image area and also causes the image transfer unit to transfer the toner images onto the recording medium such that the toner image formed of the second toner is at the top of the superposed toner images in the at least part of the image area, wherein the image controller causes, when the transfer unit is in a first mode, the plurality of image forming units to form the toner images using the second toner on a first area coverage corresponding to the first mode, and causes, when the transfer unit is in a second mode, the plurality of image forming units to form the toner images using the second toner on a second area coverage, greater than the first area coverage, corresponding to the second mode.

2. The image forming apparatus according to claim 1, wherein the image controller causes the image forming unit that uses the second toner to form, in the at least part of the image area, a uniform toner image in which the second toner is uniformly distributed, the uniform toner image being selected from among the toner images that are formed of different amounts of toners per unit area.

3. The image forming apparatus according to claim 2, wherein the image fixing unit includes a heating member that heats the toner images while coming into contact with a side of the recording medium, the side having the toner images transferred thereonto;

a pressing member that nips the recording medium in combination with the heating member and presses the recording medium against the heating member; and a pressing-temperature controller that controls the temperature of the pressing member.

4. The image forming apparatus according to claim 3, wherein the image fixing unit further includes a heating-temperature controller that sets a variable temperature value of the heating member in accordance with a total thickness of the toners that are to form the toner images to be transferred onto the recording medium in such a manner as to be superposed one on top of another.

5. The image forming apparatus according to claim 1, wherein the image fixing unit includes a heating member that heats the toner images while coming into contact with a side of the recording medium, the side having the toner images transferred thereonto;

a pressing member that nips the recording medium in combination with the heating member and presses the recording medium against the heating member; and a pressing-temperature controller that controls the temperature of the pressing member.

6. The image forming apparatus according to claim 5, wherein the image fixing unit further includes a heating-temperature controller that sets a variable temperature value of the heating member in accordance with a total thickness of the toners that are to form the toner images to be transferred onto the recording medium in such a manner as to be superposed one on top of another.

7. The image forming apparatus according to claim 6, wherein the heating-temperature controller sets the variable temperature value of the heating member to be higher as the total thickness of the toners increases.

8. The image forming apparatus according to claim 1, wherein the image controller compares a total thickness of the toners to a predetermined threshold and adjusts an amount of the plurality of first toners used by the plurality of image forming units to form the toner images according to the comparing.

9. The image forming apparatus according to claim 1, wherein the image controller causes, when the transfer unit is in a third mode, the plurality of image forming units to form the toner images using the plurality of first toners without using the second toner.

10. The image forming apparatus according to claim 9, wherein:

the image controller compares, when the transfer unit is in the third mode, a total thickness of the toners to a first predetermined threshold and adjusts an amount of the plurality of first toners used by the plurality of image forming units to form the toner images according to the comparing; and the image controller compares, when the transfer unit is in the first mode or the second mode, the total thickness of the toners to a second predetermined threshold, lower than the first predetermined threshold, and adjusts an amount of the plurality of first toners used by the plurality of image forming units to form the toner images according to the comparing.

11. An image forming method comprising:

forming a plurality of toner images by using respective toners including a plurality of first toners having different colors and a second toner having a different softening point from the first toners;

superposing, in a mode, the toner images one on top of another and transferring the superposed toner images onto a recording medium at least such that one of the toner images that is formed of the second toner is at the top of the superposed toner images; and fixing the toner images transferred onto the recording medium on the recording medium, wherein, in the mode, the toner image formed of the second toner is provided over at least part of an image area, and the toner images are transferred onto the recording medium such that the toner image formed of the second toner is at the top of the superposed toner images in the at least part of the image area, and wherein, when the mode is a first mode, the toner image formed of the second toner is formed on a first area coverage corresponding to the first mode, and, when the mode is a second mode, the toner image formed of the second toner is formed on a second area coverage, greater than the first area coverage, corresponding to the second mode.

* * * * *